US005259145A

United States Patent [19]

Fushiya et al.

[11] Patent Number: 5,259,145

[45] Date of Patent: Nov. 9, 1993

[54] CLAMP DEVICE FOR ROTARY TOOL ELEMENT

[75] Inventors: Fusao Fushiya; Tomio Ibuki; Hiroyuki Abe; Toshiyuki Tesima; Yuuji Takahashi, all of Anjo, Japan

[73] Assignee: Makita Corporation, Anjo, Japan

[21] Appl. No.: 885,897

[22] Filed: May 20, 1992

[30] Foreign Application Priority Data

May 22, 1991 [JP] Japan ..... 3-117286

[51] Int. Cl.[5] ..... B24B 41/00

[52] U.S. Cl. ..... 51/168; 51/209 R; 51/376

[58] Field of Search ..... 51/168, 206 R, 209 R, 51/376, 377, 378

[56] References Cited

U.S. PATENT DOCUMENTS

| | | | |
|---|---|---|---|
| 2,416,141 | 2/1947 | Bartho | 51/168 |
| 2,572,042 | 10/1951 | Martin | 51/168 |
| 4,625,460 | 12/1986 | Burgess et al. | 51/125 |
| 4,637,170 | 1/1987 | Block | 51/168 |
| 4,850,154 | 7/1989 | Grammer et al. | 51/209 R |
| 4,863,322 | 9/1989 | Kirchberger et al. | 51/168 |
| 4,901,479 | 2/1990 | Helm | 51/170 R |
| 4,934,107 | 6/1990 | MacKay, Jr. | 51/209 R |
| 4,941,790 | 7/1990 | Kirm | 411/432 |
| 4,955,744 | 9/1990 | Barth et al. | 403/259 |
| 4,980,994 | 1/1991 | Helm et al. | 51/168 |
| 5,161,334 | 10/1992 | Schaal et al. | 51/168 |

FOREIGN PATENT DOCUMENTS

| | | |
|---|---|---|
| 2156770 | 5/1973 | Fed. Rep. of Germany . |
| 8525316 | 10/1985 | Fed. Rep. of Germany . |
| 3917345 | 11/1990 | Fed. Rep. of Germany . |
| 9016869 | 3/1991 | Fed. Rep. of Germany . |
| 449931 | 1/1968 | Switzerland . |

*Primary Examiner*—M. Rachuba
*Assistant Examiner*—Eileen P. Morgan
*Attorney, Agent, or Firm*—Dennison, Meserole, Pollack & Scheiner

[57] ABSTRACT

A device for axially clamping a rotary tool element fitted on a spindle of a power driven tool or the like includes a first flange and a second flange. The first flange is mounted on the spindle and has an inner part rotatable with the spindle and an outer part rotatable relative to the inner part about a longitudinal axis of the spindle through a bearing. The outer part includes a first surface for abutting on one end of the rotary tool element. An engaging mechanism is disposed between the inner part and the outer part for limiting rotation of the outer part relative to the inner part within a predetermined angle. The second flange is threadably engaged with a threaded portion of the spindle and includes a second surface for abutting on the other end of the rotary tool element. The second flange is operable to be tightened for clamping the rotary tool element between the second flange and the outer part of the first flange.

10 Claims, 3 Drawing Sheets

CLAMP DEVICE FOR ROTARY TOOL ELEMENT

BACKGROUND OF THE INVENTION

1. Field of the Invention

The present invention relates to a device for clamping a rotary tool element which is mounted on a spindle of an electric power driven tool or a pneumatic tool such as a portable grinder.

2. Description of the Prior Art

A conventional device for clamping a rotary tool element of a power driven tool is shown in FIG. 5 and has a first flange 8A and a second flange 9A. The first flange 8A is fitted on a spindle 4A and is rotatable with the spindle 4A. The second flange 9A is screwed on the spindle 4A. In a mounting operation of a rotary blade 7A on the spindle 4A, the rotary blade 7A is fitted on the spindle 4A with its one end surface abutting on the the first flange 8A. The second flange 9A is thereafter screwed on a threaded portion 6A of the spindle 4A and is tightened to abut on the other end surface of the rotary blade 7A. Thus, the rotary blade 7A can be removably clamped between the first flange 8A and the second flange 9A.

With the conventional clamp device, however, since the rotary blade 7A is only simply clamped between the fixed first flange 8A and the movable second flange 9A through tightening of the second flange 9A screwed on the threaded portion 6A of the spindle 4A, the rotary blade 7A clamped between the first flange 8A and the second flange 9A may be slided or rotated by the load applied thereto during machining operation of a work in the same direction as that for fastening the second flange 9A. Thus, through the frictional force between the rotary blade 7A and the second flange 9A, the second flange 9A is further tightened to increase the clamping force.

Meanwhile, in order to change the rotary blade 7A, the second flange 9A is loosened and removed from the spindle 4A. Here, the force (torque) for loosening the second flange 9A is influenced by the frictional force between the second flange 9A and the spindle 4A produced at the threaded portion 6A, and that between the second flange 9A and the rotary blade 7A as well as that between the rotary blade 7A and the first flange 8A. Therefore, in the cutting operation of a work made especially of relatively hard material such as a brick, substantial load is applied to the rotary blade 7A, resulting in that the second flange 9A is firmly tightened. This may cause the rotary blade 7A to be worn out earlier. Meanwhile, the second flange 9A normally includes a plurality of holes for engagement with pins of a wrench which is normally attached to this kind of power driven tool , and the second flange 9A is tightened or loosened through rotation by the wrench. However, in case of loosening of the second flange 9A which is hardly tightened as described above, the rotation of the second flange 9A is frequently difficult. Further, if the wrench is compulsorily rotated, the pins or the wrench may be damaged or the holes of the second flange 9A for engagement with the pins may be deformed or enlarged to cause unreliable engagement with the pin, and consequently the device cannot be used further. Additionally, in case a lock device is provided to selectively prevent rotation of the spindle 4A for ease of loosening of the second flange 9A, the lock device and a gear housing on which the lock device is mounted are damaged by the compulsive rotation of the second flange 9A.

SUMMARY OF THE INVENTION

It is, accordingly, an object of the present invention to provide a device for clamping a rotary tool element of an electric power driven tool or a pneumatic tool which permits to easily loosen a movable flange in a simple manner for change of the rotary tool element or other operations, while ensuring reliable clamping of the rotary tool element.

According to the present invention, there is provided a device for axially clamping a rotary tool element fitted on a spindle of a power driven tool or the like, comprising:

a first flange mounted on the spindle and having an inner part rotatable with the spindle and an outer part rotatable relative to the inner part about a longitudinal axis of the spindle through a bearing, the outer part having a first surface for abutting on one end of the rotary tool element;

an engaging mechanism disposed between the inner part and the outer part for limiting rotation of the outer part relative to the inner part within a predetermined angle; and a second flange threadably engaged with a threaded portion of the spindle and having a second surface for abutting on the other end of the rotary tool element, the second flange being operable to be tightened for clamping the rotary tool element between the second flange and the outer part of the first flange.

The invention will become more fully apparent from the claims and the description as it proceeds in connection with the drawings.

DETAILED DESCRIPTION OF THE PREFERRED EMBODIMENT

Figure 1:
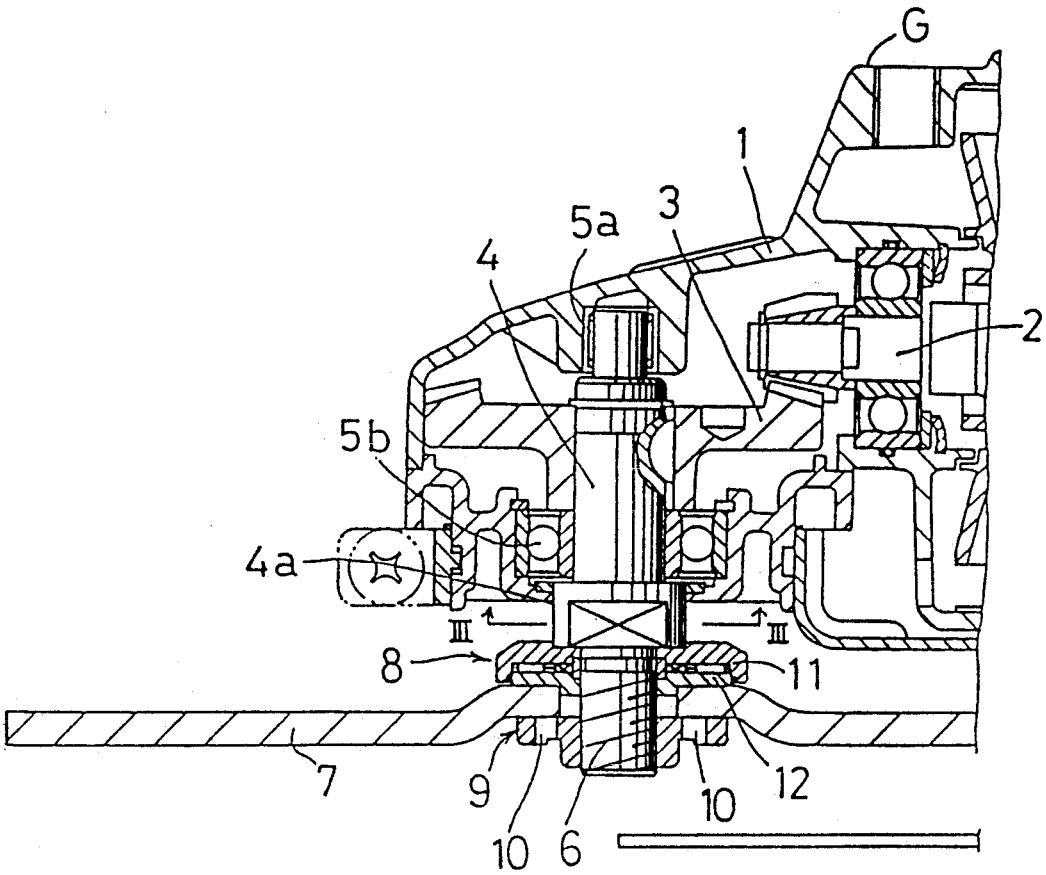
FIG. 1 is a vertical sectional view of a lower part of a power driven grinder with a grinding wheel clamped by a clamp device according to an embodiment of the present invention.

Referring to FIG. 1, there is shown a sectional view of a lower part of a portable power driven grinder having a body G. The body G includes a gear box 1 into which an output shaft 2 of a motor (not shown) extends. A spindle 4 is rotatably supported by bearings **5*a* and 5*b* mounted on the gear box 1 and is connected to the output shaft 2 through reduction gears 3. One end of the spindle 4 extends downwardly from the bottom of the gear box 1 and is formed with a threaded portion 6. A flange portion 4*a* is formed adjacent above the threaded portion 6 and is chamfered at both sides diametrically opposed to each other as shown in FIG. 3**.

A device for clamping a disc-like grinding wheel 7 includes a first flange 8 and a second flange 9. The first flange 8 is axially displaceably mounted on the spindle 4 and is in engagement with the flange portion **4*a* for rotation with the spindle 4. The second flange 9 is screwed on the threaded portion 6 and includes a plurality of holes 10 for engagement with a wrench (not shown) which applies rotation to the second flange 9 to tighten the same for clamping the grinding wheel 7 between the first flange 8 and the second flange 9**.

Figure 2:
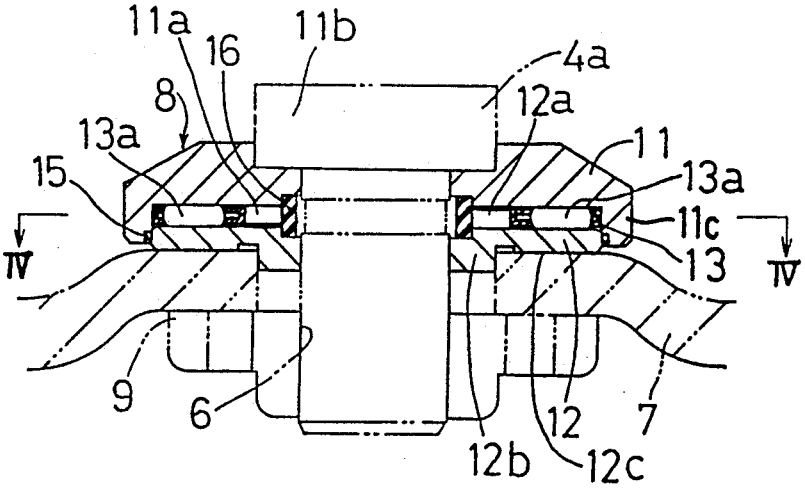
FIG. 2 is an enlarged sectional view of the device shown in FIG. 1
Figure 3:
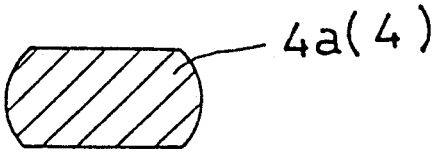
FIG. 3 is a sectional view taken along line III—III in FIG. 1.
Figure 4:
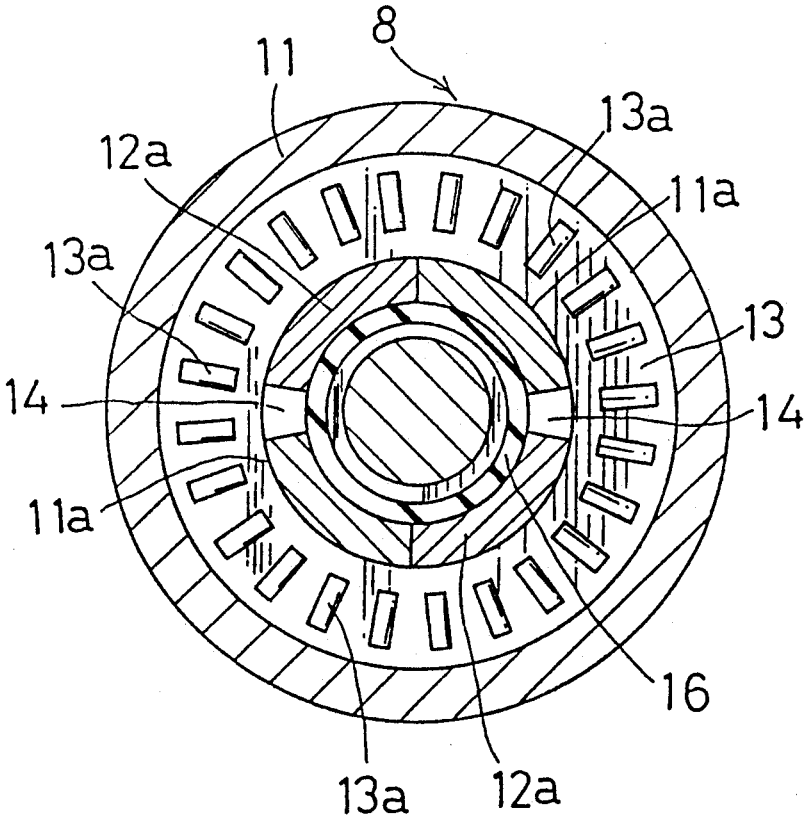
FIG. 4 is a sectional view taken along line IV—IV in FIG. 2.
Figure 5:
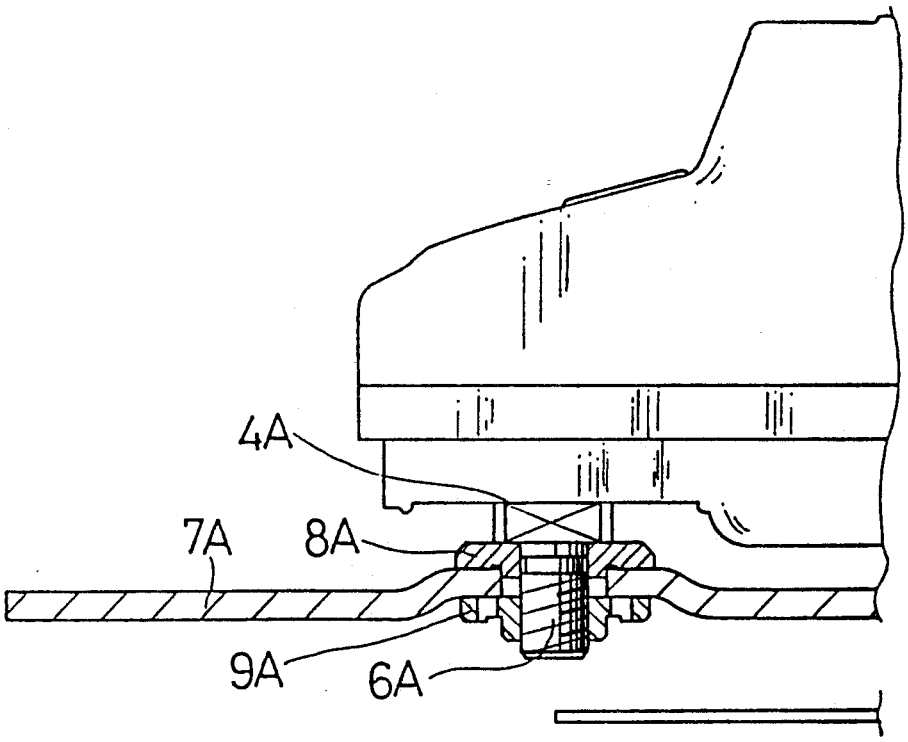
FIG. 5 PRIOR ART
FIG. 5 is a front view of a lower part of a power driven grinder with a grinding wheel clamped by a conventional device.

As shown in FIGS. 2 to 4, the first flange 8 is separated into a cup-shaped inner part 11 and an annular outer part 12 to form a space therebetween for accommodating an annular needle bearing 13 having a plurality of needle rollers 13*a* disposed in a radial direction and spaced from each other in a circumferential direction. A pair of partly annular protrusions 11*a* and a pair of partly annular protrusions 12*a* similar thereto are formed with the inner part 11 and the outer part 12, respectively. The annular protrusions 11*a* and the annular protrusions 12*a* extend in an axial direction toward the outer part 12 and the inner part 11, respectively, and are disposed complementary to each other. Here, the pair of the annular protrusions 12*a* as well as the pair of the annular protrusions 11*a* are diametrically opposed to each other in a symmetrical manner to form a pair of equivalent clearances or recesses therebetween. Each of the protrusions 11*a* and 12*a* has a circumferential length shorter than that of each of the clearances, so that the outer part 12 can be rotated relative to the inner part 11 within a predetermined range. Thus, in case the outer part 12 is at a position where each of the pair of the annular protrusions 12*a* abuts on each one of the annular protrusions 11*a* disposed in a counterclockwise direction as shown in FIG. 4, a gap 14 is formed between each of the annular protrusions 12*a* and each of the annular protrusions 11*a* disposed in a clockwise direction thereof.

The inner part 11 of the first flange 8 has at its upper portion a recess 11*b* which corresponds to the flange portion 4*a* of the spindle 4 and is in engagement therewith, so that the inner part 11 can rotate with the spindle 4. Further, the inner part 11 has a flanged outer peripheral portion 11*c*, and the needle bearing 13 is received between the annular protrusions 11*a* and the outer peripheral portion 11*c*.

The outer part 12 includes a boss portion 12*b* and a lower planer surface 12*c*. The grinding wheel 7 is supported by the boss portion 12*b* with its upper surface abutting on the planer surface 12*c*.

An O-ring 15 is inserted between the outer peripheral portion 11*c* of the inner part 11 and the outer peripheral surface of the outer part 12. Further, a rubber annular ring 16 is interposed between the inner part 11 and the outer part 12 at a position adjacent the spindle 4. Thus, the O-ring 15 and the annular ring 16 function to seal the space formed between the inner part 11 and the outer part 12 from the outside so as to prevent entry of dust to the space. The O-ring 15 further functions to prevent removal of the outer part 12 from the inner part 11.

The surface of the threaded portion 6 of the spindle 4 may be coated with a tetrafluoroethylene or Teflon coating for reducing frictional force with the second flange 9. Similarly, the entire surface of the second flange 9 may be coated with a molybdenum-based coating or is soft-nitrided for reduction of frictional force.

The operation of the above clamping device will now be explained. With the first flange 8 fitted on the spindle 4 for rotation therewith through engagement of the flanged portion 4*a* of the spindle 4 with the recess 11*b*, the grinding wheel 7 is axially moved on the spindle 4 beyond the threaded portion 6 and is fitted on the boss portion 12*b* of the outer part 12 of the first flange 8 with the upper surface abutted on the lower surface 12*c* of the outer part 12 . The second flange 9 is thereafter screwed on the threaded portion 6 and is tightened for clamping the grinding wheel 7 between the first flange 8 and the second flange 9 by a desired force (torque).

At the beginning of tightening of the second flange 9, the outer part 12 of the first flange 8 as well as the grinding wheel 7 may rotate with the second flange 9. The rotation of the outer part 12 is, however, prevented when the protrusion 12*a* of the outer part 12 is engaged with the protrusion 11*a* of the inner part 11 as shown in FIG. 4, and the outer part 12 cannot be rotated further. Therefore, the grinding wheel 7 can be clamped between the outer part 12 of the first flange 8 and the second flange 9 as the second flange 9 is further tightened.

To change the grinding wheel 7, the second flange 9 is rotated in a reverse direction so as to be loosened and is thereafter removed from the spindle 4.

When the second flange 9 is rotated in the reverse direction for loosening, such force (torque) for loosening may be reduced because of the existence of the needle roller bearing 13 interposed between the inner part 11 and the outer part 12 of the first flange 8. Thus, the needle roller bearing 13 reduces the frictional force between the inner part 11 and the outer part 12 of the first flange 8 to become smaller than that between the outer part 12 and the grinding wheel 7 as well as that between the grinding wheel 7 and the second flange 9 . Therefore, the outer part 12, the grinding wheel 7 and the second flange 9 may be rotated together relative to the inner part 11 of the first flange 8 at the beginning of the reverse rotation of the second flange 9. Consequently, the rotational force (torque) depends on the frictional force between the threaded portion 6 of the spindle 4 and the second flange 9 and the frictional force between the inner part 11 and the outer part 12 of the first flange 8, and since such frictional force between the inner part 11 and the outer part 12 is relatively small because of rolling friction, the force (torque) for rotation of the second flange 9 may be reduced.

The following experimental results have been obtained for the device of the above embodiment in comparison with the conventional clamp device with respect to the same fastening torque:

| | Device of Embodiment | Conventional Device |
|---|---|---|
| | Fastening Torque: 500 Kg-cm | |
| Loosening Torque | 160 Kg-cm | 425 Kg-cm |
| | Fastening Torque: 1000 Kg-cm | |
| Loosening Torque | 270 Kg-cm | 800 Kg-cm |
| | Fastening Torque: 1200 Kg-cm | |
| Loosening Torque | 350 Kg-cm | 1000 Kg-cm |

Additionally, a more excellent result has been obtained by coating the surface of the threaded portion 6 of the spindle 4 with the Teflon coating and/or by coating the entire surface of the second flange 9 with the molybdenum based-coating or by soft-nitriding the same for reduction of frictional force.

Although, with the above embodiment, the needle roller bearing 13 is interposed between the inner part 11 and the outer part 12 of the first flange, any other rolling bearings other than the needle roller bearing 13 can be used for permitting rotation of the outer part 12 relative to the inner part 11.

While the invention has been described with reference to a preferred embodiments thereof, it is to be understood that modifications or variations may be easily made without departing from the scope of the present invention which is defined by the appended claims.

What is claimed is:

1. A device for axially clamping a rotary tool element which is fitted on a spindle of a rotary tool, comprising:

a first flange mounted on the spindle and having an inner part rotatable with the spindle and an outer part rotatable relative to said inner part about a longitudinal axis of the spindle through roller bearing means, said outer part having a first surface for abutting on one end of the rotary tool element;

engaging means disposed between said inner part and said outer part; said engaging means including a first engaging surface formed on said inner part and a second engaging surface formed on said outer part, respectively; and a second flange threadably engaged with a threaded portion of the spindle and having a second surface for abutting on the other end of the rotary tool element, said second flange being operable to be tightened for clamping said rotary tool element between said second flange and said outer part of said first flange;

said first and second engaging surfaces on said inner and outer parts being movable toward and away from each other in a circumferential direction as said outer part is rotated relative to said inner part, and said first and second engaging surfaces, upon rotation of said outer part relative to said inner part, selectively abutting each other solely in a circumferential direction to prevent further rotation of said outer part relative to said inner part, said outer part, upon rotation relative to said inner part, being retained against axial movement relative thereto.

2. A device for axially clamping a rotary tool element which is fitted on a spindle of a rotary tool, comprising:

a first flange mounted on the spindle and having an inner part and an outer part, said inner part being rotatable with the spindle, said outer part being mounted on said inner part and retained against movement relative thereto in an axial direction, roller bearing means, said outer part being rotatable relative to said inner part about a longitudinal axis of the spindle through said roller bearing means, and said outer part having a first surface for abutting on one end of the rotary tool element;

engaging means disposed between said inner part and said outer part and including a protruding portion and a recess for receiving said protruding portion, said protruding portion being formed on one of said inner part and said outer part, and said recess being formed on the other of said inner part and said outer part;

said recess having a longer size than said protruding portion in a circumferential direction and having abutting surfaces at both ends in the circumferential direction so as to permit rotation of said outer part relative to said inner part within a predetermined angle but to prevent rotation of said outer part relative to said inner part in excess of said predetermined angle through abutment of said protruding portion on said abutting surfaces; and a second flange threadably engaged with a threaded portion of the spindle and having a second surface for abutting on the other end of the rotary tool element for clamping of the rotary tool element between said first flange and said second flange as said second flange is rotated in one direction and upon abutment of said protruding portion with one of said abutting surfaces to preclude rotation between said inner and outer parts, said outer part, upon rotation of said second flange in a reverse direction, rotating within said predetermined angle relative to said inner part with the air of said roller bearing means to facilitate loosening of said second flange on said spindle.

3. The device as defined in claim 2 wherein said protruding portion includes a first protrusion and a second protrusion formed on said inner part and said outer part of said first flange, respectively.

4. The device as defined in claim 3 including a pair of said first protrusions and a pair of said second protrusions each disposed in diametrically opposed relationship with each other, and said pair of said first protrusions and said pair of second protrusions each forming a said recess therebetween.

5. The device as defined in claim 2 wherein said threaded portion of the spindle is treated with a Teflon coating for reduction of frictional force between said threaded portion and said second flange.

6. The device as defined in claim 2 wherein said second surface of said second flange is treated with a molybdenum coating for reduction of frictional force.

7. The device as defined in claim 2 wherein said second surface of said second flange is soft-nitrided for reduction of frictional force.

8. The device as defined in claim 3 wherein:

said roller bearing means is a needle roller bearing:

said inner part and said outer part defining a space therebetween accommodating said bearing; and each of said first and said second protrusions extending into said space at a position adjacent and inwardly of said roller bearing means in a radial direction.

9. The device as defined in claim 8 wherein a first and a second resilient sealing member are disposed between said inner part and said outer part at a position inwardly of said first and second protrusions in the radial direction and at a position outwardly of said roller bearing means in the radial direction, respectively, so as to seal said space from the outside.

10. The device as defined in claim 8 wherein:

said inner part includes at its peripheral portion an annular flange portion extending toward said outer portion; and said roller bearing means is received between said flange portion and said first protrusion.

* * * * *